US005926893A

United States Patent [19]

Cestari et al.

[11] Patent Number: 5,926,893

[45] Date of Patent: Jul. 27, 1999

[54] ROTATING, WATER-FED BRUSH DEVICE FOR THE INTERNAL CLEANING OF WATER CLOSETS AND SIMILAR FIXTURES

[76] Inventors: Pietro Cestari, via Alberelle, 41-26013, Crema CR; Giuseppe De Bella, strada Malaspina, 15, 20100 Milano, both of Italy

[21] Appl. No.: 08/836,028

[22] PCT Filed: Oct. 4, 1995

[86] PCT No.: PCT/IT95/00157

§ 371 Date: May 2, 1997

§ 102(e) Date: May 2, 1997

[87] PCT Pub. No.: WO97/09489

PCT Pub. Date: Mar. 13, 1997

[30] Foreign Application Priority Data

Sep. 4, 1995 [IT] Italy ..... RM95A0591

[51] Int. Cl.[6] ..... A46B 11/06

[52] U.S. Cl. ..... 15/29; 15/24; 4/300.2

[58] Field of Search ..... 15/23, 24, 28, 15/29; 4/255.04, 300.2, 661, 443

[56] References Cited

U.S. PATENT DOCUMENTS

| | | | |
|---|---|---|---|
| 2,627,074 | 2/1953 | Karp | 4/443 |
| 2,682,675 | 7/1954 | Prucha | 15/29 |
| 3,387,312 | 6/1968 | Westphal . | |
| 3,646,617 | 3/1972 | Heald | 4/300.2 |
| 4,217,671 | 8/1980 | Rand . | |
| 4,345,343 | 8/1982 | Shipman . | |
| 4,766,622 | 8/1988 | Pacelli | 4/300.2 |
| 4,918,769 | 4/1990 | Gandini . | |
| 5,235,717 | 8/1993 | Lanzo et al. | 15/24 |

FOREIGN PATENT DOCUMENTS

| | | | |
|---|---|---|---|
| 1 233 908 | 10/1960 | France . | |
| 30 25 293A1 | 1/1982 | Germany . | |
| 32 09 527A1 | 10/1983 | Germany . | |
| 40-3-280912 | 12/1991 | Japan | 15/28 |
| 2 175 494 | 12/1986 | United Kingdom . | |

*Primary Examiner*—Terrence R. Till

*Attorney, Agent, or Firm*—Smith, Gambrell & Russell, LLP; Beveridge, DeGrandi, Weilacher & Young Intellectual Property Group

[57] ABSTRACT

Apparatus for cleaning internal surfaces of water closets ("WCs") and similar fixtures includes a container to be placed near the fixture to be cleaned. A brush is stored in a lower section of the container, and it is removed from the container to clean the WC. A water supply system in an upper section of the container includes water conduits and a flexible tube which is retractably mounted on a rolling up device. Water flows from the flexible tube through the brush handle to an impeller which rotates the brush, and the water sprays the bristles to keep the brush clean and to prevent the formation of deposits on the bristles. When the brush is inside the container, a cleaning rod protrudes into the bristles, and the brush is rotated to clean its bristles further.

4 Claims, 2 Drawing Sheets

ROTATING, WATER-FED BRUSH DEVICE FOR THE INTERNAL CLEANING OF WATER CLOSETS AND SIMILAR FIXTURES

BACKGROUND

The present invention concerns a device housed in a container placed beside a water closet ("WC") or similar fixture. The device includes a rotating brush which is fed by the water pressure of the system and is mounted on a handle which can be grasped to reach and clean the internal surface of WCs and similar fixtures.

It is well known that conventional WC cleaning devices such as manual whiskers or cleaners, after they remove all toilet residues, remain impregnated therewith. The consequent presence of the residue is unhealthy and it causes unpleasant odors.

The main purpose of the present invention is to eliminate hygienic-sanitary deficiencies and to assure hygiene and health, particularly in public facilities like hospitals, schools, communities, railway stations, filling stations, cinemas, and, in general, all those structures in which many people use the bathrooms every day.

The advantages of the device according to the present invention are many and considerable:

- it prevents the deposition of fecal and other contaminants on the cleaning device;
- it facilitates the total and easy removal of solid and/or liquid organic residue from the WC;
- it allows a careful cleaning of the WC in those parts that cannot be reached with conventional means;
- it provides optimal results in hygienic and practical respects;
- it eliminates deposits of the type which are always present in the containers of existing WC cleaning devices; and,
- it prevents unpleasant odors.

SUMMARY OF THE INVENTION

According to the present invention, an apparatus for cleaning the internal surfaces of a WC or similar fixture includes a brush supported in a container which is divided into separate upper and lower sections. The brush is rotatably mounted on a handle, and it is removable from the container to reach and clean the internal surfaces of a WC. An actuator is operated to release water onto the bristles of the brush. The upper section of the container encloses a water supply system for feeding warm or cold water to a flexible tube which feeds water to the brush. Also inside the upper section is a device for rolling up the flexible tube. This device allows the unrolling of the flexible tube from the device and the return of the flexible tube to its rolled up condition. The lower section of the container has a sealing door, a drain hole for discharging to a sewer any residue dripping from the brush, and a cleaning rod which protrudes into the bristles of the brush in the container to clean the bristles when the brush is rotated inside the container.

Preferably, there is a duct inside the brush handle, and an impeller which receives water from the duct to rotate the brush in response to the pressure of water received by the impeller. The water supply system feeds water to the brush to clean it further when the brush is in the lower section of the container.

Other optional features of the invention are that the container has an external sealing door, the brush is rotated at a speed of about 200–250 revolutions per minute, the flexible tube has a quick connection to the brush handle, and the upper section of the container is provided with conduits and taps for warm water and cold water.

BRIEF DESCRIPTION OF THE DRAWINGS

The present invention will be described more in detail hereinbelow referring to the enclosed drawings in which a preferred embodiment thereof is shown.

DETAILED DESCRIPTION

The enclosed figures show a rotating, water-fed brush device according to the present invention, for the internal cleaning of WCs and similar fixtures. The device includes a container, preferably of plastic material, is divided into an upper section 1 and a lower section 2.

Figure 1:
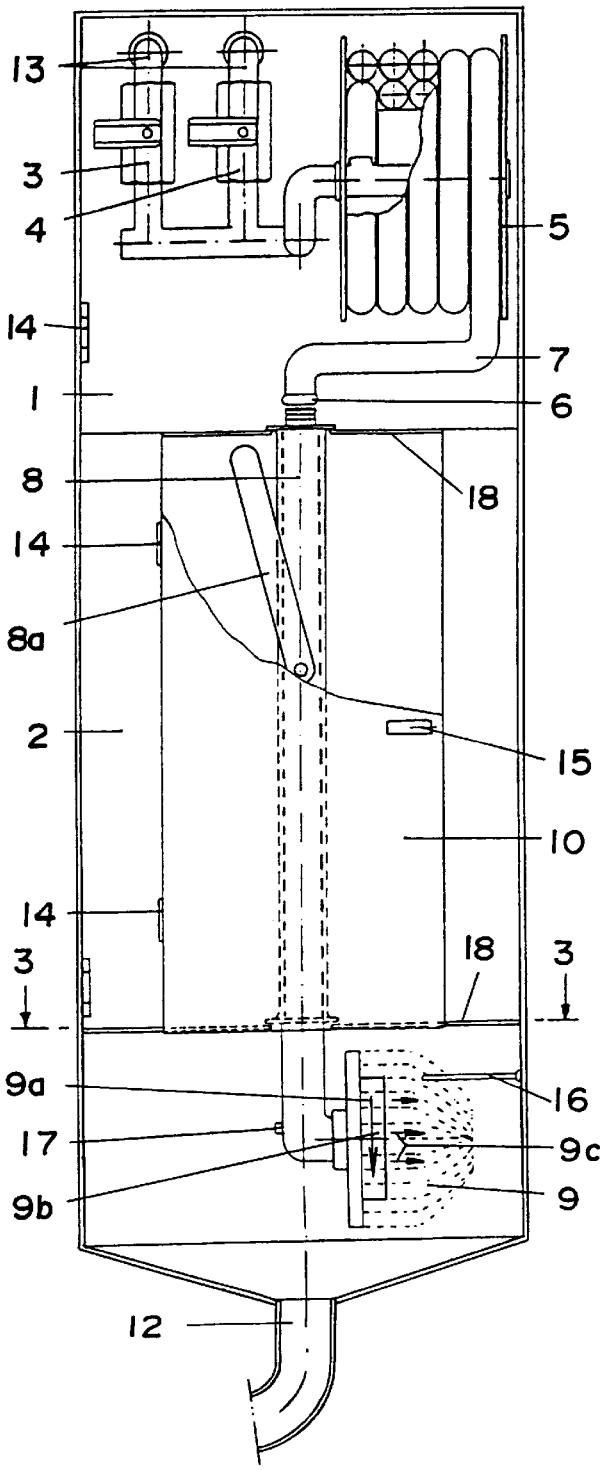
FIGS. 1 and 2 show internal front and side views of a rotating, water-fed brush device according to the present invention, for the internal cleaning of WCs and similar fixtures.
Figure 2:
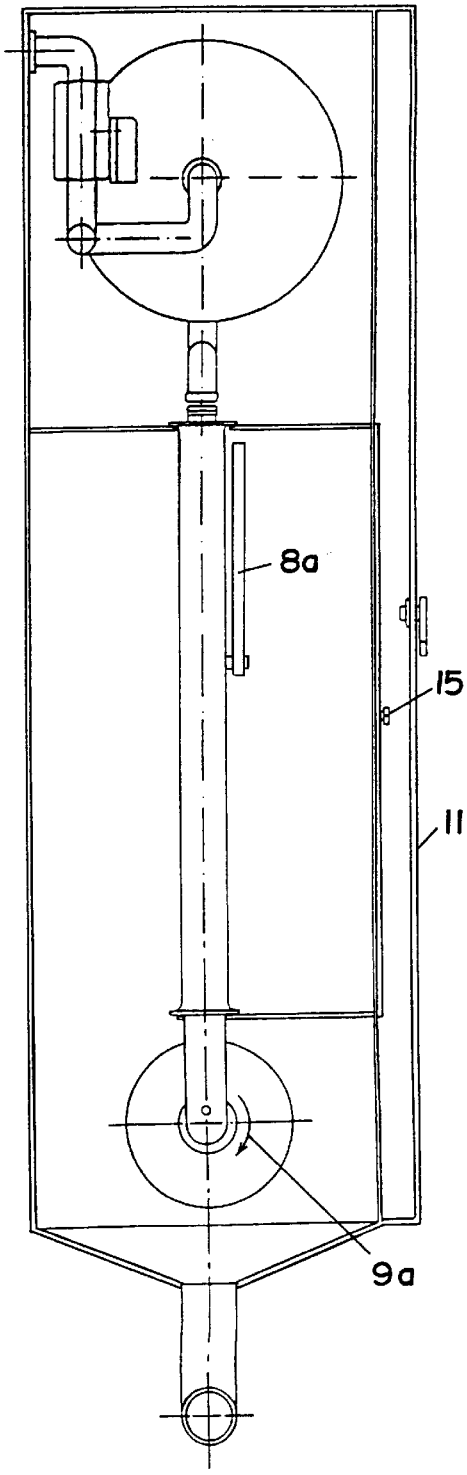
Figure 3:
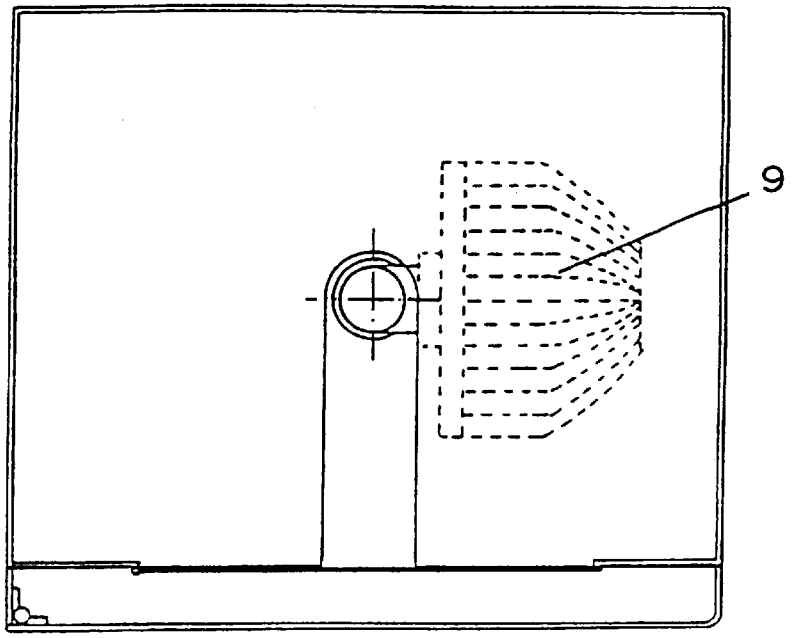
FIG. 3 shows in detail a section 3—3 of FIG. 1.
Figure 4:
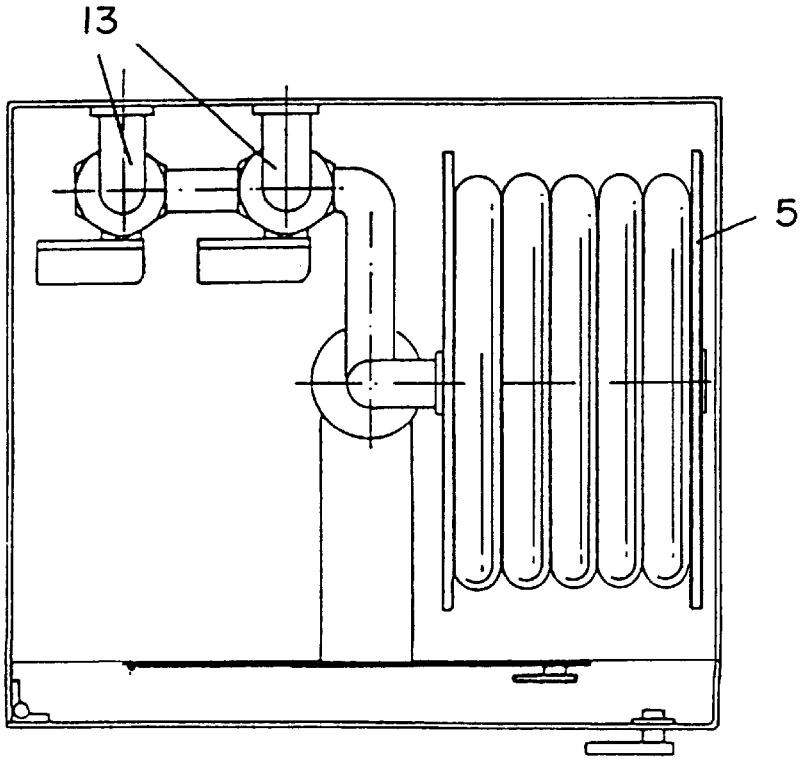
FIG. 4 is a view of the details present in the upper part of the container.

A brush 9 is rotated at low speed by water which moves through a duct in the brush handle 8 to an impeller 9*a*. The brush rotates in the range of 200–250 revolutions/minute, and it can reach and carefully clean each part of the WC. The rotary movement is represented by the arrows 9*b* in FIGS. 1 and 2. The brush is fed with warm or cold water by a flexible tube 7. A quick connection 6 system at the top of the brush handle 8 is shown in FIG. 1. The brush has a pressure lever 8*a* which serves as an actuator to control the release of water, so that the brush bristles are constantly sprayed during rotation, as shown by the arrows in 9*c* in FIG. 1. A switch 17 may be operated to release the brush from its handle.

A water feeding system in the upper section 1 of the container includes two ducts 13 with taps 3 and 4 for feeding warm or cold water, a water feeding tube 7 with quick connections, and a device 5 for rolling up the water feeding tube. This device allows the water feeding tube to be extended for use and to be returned after use by a return spring.

The lower section 2 of the container includes a vertical housing with a sealing internal door 10, a hinge 14 and a lock 15. This housing is provided with supports 18 for supporting the brush handle 8 for storage. A drainage hole 12 in the bottom of the container is provided to discharge any dripping residue to the main sewer.

A cleaning rod 16 of circular cross section is mounted on an internal lateral wall of the housing to rub and internally clean the bristles of the brush 9.

During the operation of the device according to the present invention, a duct inside the brush handle 8 carries water under pressure to an impeller 9*a* in the brush, thus rotating the brush and constantly spraying the brush bristles during rotation.

The use of cold water allows an energy saving while still assuring an accurate cleaning. Warm water accelerates and facilitates the removal of particularly resistant residues.

The user may perform a further cleaning of the brush by placing it in its container, closing the internal door 10, and operating the brush for a few seconds to spray the bristles and rub them against the rod 16. This will assure an absolute cleaning by removing the residues accumulated in the brush during the cleaning of the WC.

Should the user wish to replace a worn out brush or use one with a different geometrical shape, it will be sufficient to release the brush from the handle by operating the switch 17, removing the brush from the handle 8 and replacing it with another brush.

We claim:

1. Apparatus for cleaning internal surfaces of a WC or similar fixture, comprising:

a container divided into separate upper and lower sections, and a support for supporting a brush in said container;

a brush handle, a brush rotatably mounted on said handle, said brush having bristles and being removable from the container to reach and clean said internal surfaces of a WC;

a flexible tube for feeding warm or cold water to said brush, an actuator which is operable to release water from said flexible tube onto the bristles of the brush during its rotation;

said upper section of the container containing a water feeding system for feeding water to said flexible tube, and a device for rolling up the flexible tube, said device allowing the unrolling of the flexible tube from the device and the return of the flexible tube to its rolled up condition on the device;

said lower section of the container including a sealing door, a drain hole for discharging to a sewer any residue dripping from the brush, and a cleaning rod which protrudes into the bristles of a brush in the container to clean the bristles when the brush is rotated inside said container.

2. Apparatus according to claim 1 including a duct inside the brush handle, an impeller which is supported on the brush handle and receives water from the duct, said brush being rotated in response to the pressure of water received by said impeller from said duct.

3. Apparatus according to claim 1 wherein the water supply system is operable to feed water to the brush to clean it further when the brush is in the lower section of the container.

4. Apparatus according to claim 1 wherein the container has an external sealing door, the brush is rotated at a speed of about 200–250 revolutions per minute, the flexible tube has a quick connection to the brush handle, and the upper section of the container is provided with conduits and taps for warm water and cold water.

* * * * *